US007021861B2

(12) United States Patent
Basta

(10) Patent No.: US 7,021,861 B2
(45) **Date of Patent: *Apr. 4, 2006**

(54) LOW PROFILE FLOATING LIFT FOR WATERCRAFT

(75) Inventor: Samuel T. Basta, Bellevue, WA (US)

(73) Assignee: IPO L.L.C., Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/816,992

(22) Filed: Apr. 2, 2004

(65) Prior Publication Data

US 2004/0184883 A1 Sep. 23, 2004

Related U.S. Application Data

(63) Continuation of application No. PCT/US01/46253, filed on Oct. 23, 2001, which is a continuation-in-part of application No. 09/316,928, filed on May 21, 1999, now Pat. No. 6,318,929.

(60) Provisional application No. 60/086,428, filed on May 22, 1998.

(51) Int. Cl.
*B63C 3/06* (2006.01)
*B63C 3/12* (2006.01)

(52) U.S. Cl. ..... 405/3; 114/44; 114/48; 254/10 C; 414/678

(58) Field of Classification Search ..... 405/1–3; 114/44, 45, 46, 47, 48; 254/10 C, 10 R; 414/678

See application file for complete search history.

(56) References Cited

U.S. PATENT DOCUMENTS

| | | | | |
|---|---|---|---|---|
| 4,072,119 | A | 2/1978 | Williams | 114/45 |
| 5,184,914 | A | 2/1993 | Basta | 405/3 |
| 5,485,798 | A | 1/1996 | Samoian et al. | 114/44 |
| 5,860,379 | A | 1/1999 | Moody | 114/54 |
| 5,908,264 | A | 6/1999 | Hey | 405/3 |
| 6,076,478 | A * | 6/2000 | Siegmann | 114/45 |
| 6,131,528 | A * | 10/2000 | Meek et al. | 114/44 |
| 6,752,096 | B1 * | 6/2004 | Elson et al. | 114/45 |
| 6,752,097 | B1 * | 6/2004 | Elson et al. | 114/45 |

* cited by examiner

*Primary Examiner*—Thomas B. Will
*Assistant Examiner*—Tara L. Mayo

(57) ABSTRACT

A floating low profile watercraft lifting apparatus comprises a buoyant support apparatus and a watercraft lift attached to the buoyant support apparatus. Embodiments of the lift have first and second cantilever arms pivotally mounted to a base at offset pivot points for use in shallow water. The lift includes an actuator connected to the first and second cantilever arms and operable to move the first and second cantilever arms between a collapsed configuration and an extended configuration with uniform application of force and a minimum amount of travel of actuator components. Embodiments of the support apparatus comprise pontoons within a frame attached to the lift and providing buoyant support for the lifting apparatus.

21 Claims, 12 Drawing Sheets

LOW PROFILE FLOATING LIFT FOR WATERCRAFT

CROSS-REFERENCE TO RELATED APPLICATION

This application is a continuation of PCT Application No. PCT/US01/46253, filed Oct. 23, 2001, which is a continuation-in-part of U.S. application Ser. No. 09/316,928, filed May 21, 1999, now U.S. Pat. No. 6,318,929 and claims priority from U.S. provisional application No. 60/086,428, filed May 22, 1998, entitled LOW PROFILE LIFT FOR WATERCRAFT.

BACKGROUND OF THE INVENTION

1. Technical Field

The invention relates to lifting devices, and in particular to floating devices for lifting watercraft, for example, boats and sea planes.

2. Description of the Related Art

Known is U.S. Pat. No. 5,184,914 issued to the inventor of the present invention which is incorporated herein by reference and discloses a watercraft lifting device having a rectangular stationary base formed of two longitudinal parallel beams and two transverse beams, generally described as front and rear transverse beams. The rectangular base is submersible under water. Pivoting booms connect each of the four corners of the rectangular base to swingable mounting arms positioned parallel to and coplanar with each of the longitudinal beams to form two pairs of pivoting booms, generally described as front and rear pivoting booms. The two pair of pivoting booms form with the mounting arms collapsing parallelograms on which watercraft supports extended a predetermined distance above the mounting arms hold the craft during lifting. A double-acting hydraulic cylinder is pivotally connected to the rear transverse beam and its piston rod is pivotally connected to the two front pivoting booms such that expansive energization of the double-acting hydraulic cylinder extends the piston rod and swings front pair of pivoting booms upward from a collapsed configuration. The parallelogram linkage forces the mounting arms and rear pair of pivoting booms to follow the front pair of pivoting booms. Thus, expansive energization of the double-acting hydraulic cylinder raises the front pair of pivoting booms and lifts the rear pair of pivoting booms, the mounting arms and the watercraft supports attached to the mounting arms upward to lift a watercraft out of the water. Upward movement continues until the pivoting booms pass through a vertical orientation into an over-center orientation whereby the watercraft is supported above the surface of the water.

Retractive energization of the double-acting hydraulic cylinder retracts the piston rod into the piston jacket of the double-acting hydraulic cylinder and reverses the motion of the pivoting booms. Thus, retractive energization of the double-acting hydraulic cylinder first raises the pivoting booms and lifts the mounting arms and watercraft supports attached to the mounting arms upward. Upward movement causes the pivoting booms to pass back through vertical orientation. Continued retraction of the piston rod into the double-acting hydraulic cylinder combined with the weight of the latching apparatus and the watercraft collapses the parallelograms whereby the watercraft is lowered into the water. The piston rod continues to retract into the double-acting hydraulic cylinder collapsing the parallelograms, including the mounting arms and watercraft supports attached to the mounting arms, until contact between the watercraft supports and the watercraft is broken and the watercraft can float free.

Although the apparatus of the prior art operates effectively in many practical applications, a need exists for a floating watercraft lifting apparatus that operates effectively in shallow water applications where the typical water depth is minimal and the apparatus of the prior art cannot collapse sufficiently to break contact between the watercraft supports and the watercraft and release the watercraft to float free, and where the depth of the water varies due to tides, seasonal fluctuations, and the like.

BRIEF SUMMARY OF THE INVENTION

The present invention resolves limitations of the prior art by providing a floating low profile watercraft lifting apparatus. In one embodiment, a floating watercraft lifting apparatus is provided that includes a pair of floats, a support frame with support stands, and a lift having a generally rectangular base adapted to be submerged under water. The base is formed of two longitudinal beams joined by two transverse beams generally described as front and rear transverse beams. Pivoting booms connect each of the four corners of the rectangular base to swingable mounting arms positioned generally parallel with the longitudinal beams to form two pairs of pivoting booms, generally described as a front pair of pivoting booms and a rear pair of pivoting booms. The pivoting booms form with the mounting arms collapsing mock parallelograms on which watercraft supports hold the craft during lifting.

BRIEF DESCRIPTION OF THE SEVERAL VIEWS OF THE DRAWINGS

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE INVENTION

Figure 1:
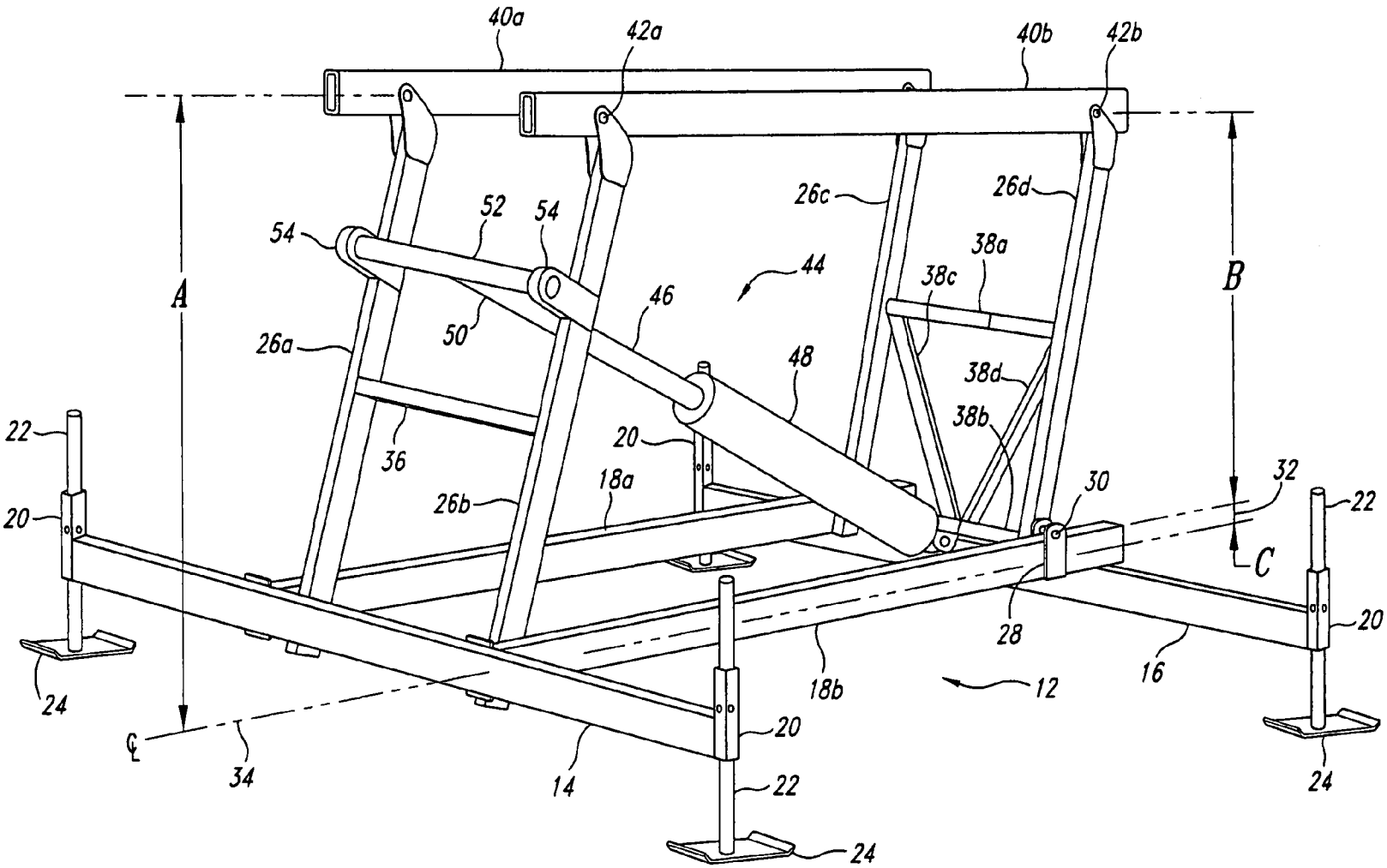
FIG. 1 is an isometric view of the low profile watercraft lifting apparatus according to one embodiment of the present invention shown in an extended configuration.
Figure 2:
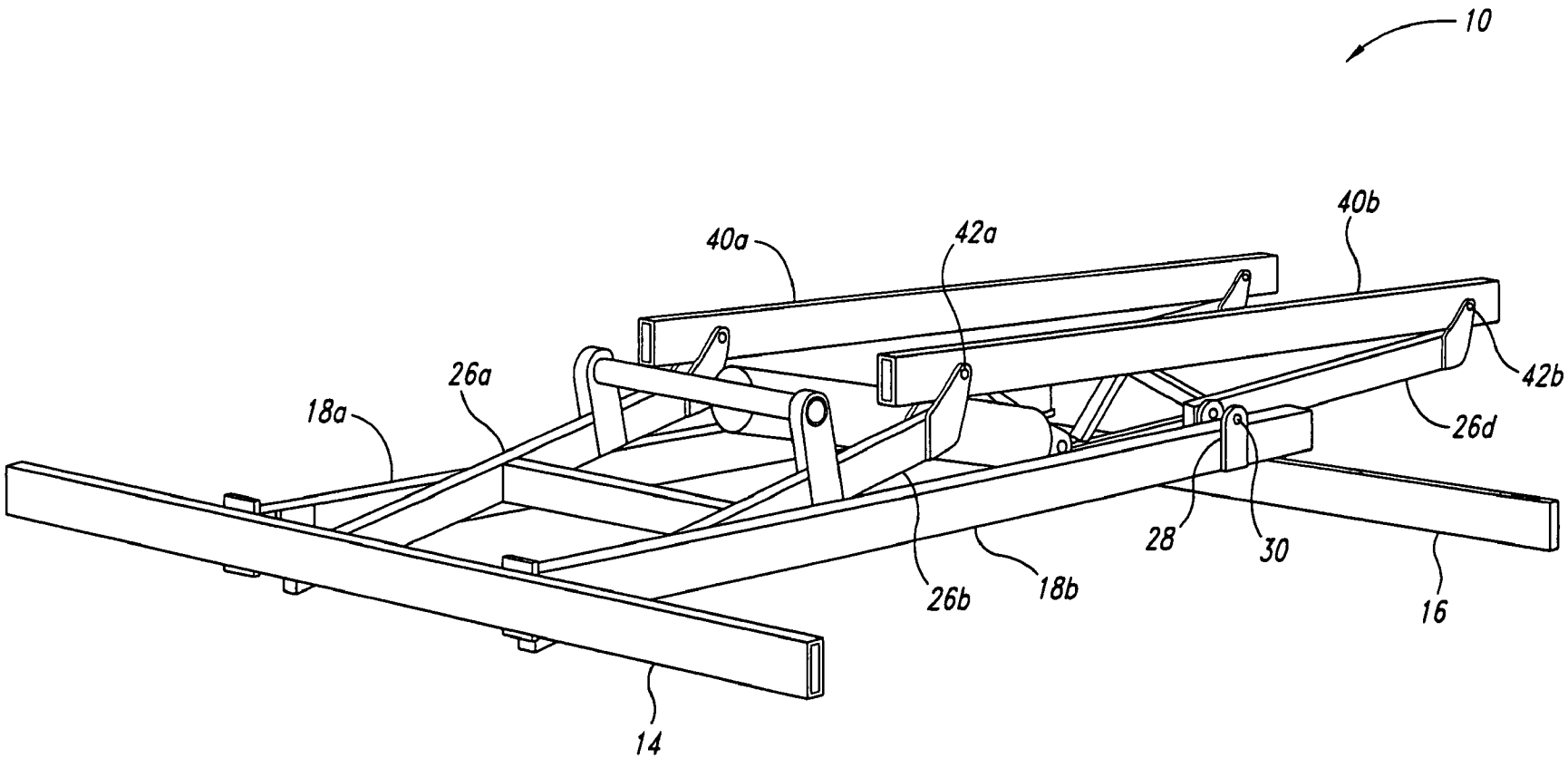
FIG. 2 is an isometric view of the low profile watercraft lifting apparatus of FIG. 1 shown in a collapsed configuration.

FIGS. 1 and 2 show isometric views of the low profile watercraft lifting apparatus according to one embodiment of the present invention in an upright or extended configuration and a collapsed attitude, respectively. In FIGS. 1 and 2 the watercraft lifting apparatus 10 includes an essentially rectangular base 12 including a front transverse beam 14 and a rear transverse beam 16 connected to opposite ends of spaced-apart longitudinal beams 18*a*, 18*b*. In one embodiment, longitudinal beams 18*a*, 18*b* are essentially equal in length and parallel with one another and transverse beams 114, 116 extend beyond the connection points with longitudinal beams 18*a*, 18*b* to form "I"-shaped base 12. In a preferred embodiment, base 12 further includes four sleeves 20. One sleeve 20 is connected to each end of transverse beams 14, 16. Each sleeve 20 receives a support post 22 which is independently adjustable for positioning and leveling base 12 at a desired depth submerged under water. Support posts 22 include shoes 24 which rest on the river or lake bed.

Four pivoting booms 26*a*, 26*b*, 26*c*, 26*d* are attached to rectangular base 12, one pivoting boom 26 adjacent each of the four corners of rectangular base 12, with the lower ends of each front boom 26*a*, 26*b* pivotally joined to base 12 adjacent front ends of each longitudinal beam 18*a*, 18*b* and the lower ends of each rear boom 26*c*, 26*d* pivotally joined to base 12 adjacent rear ends of each longitudinal beam 18*a*, 18*b*. In a preferred embodiment, longitudinal beams 18*a*, 18*b* are fitted with brackets 28 which include a pivot point 30 extended an off-set distance 32 above the centerline 34 of longitudinal beams 18*a*, 18*b*. Brackets 28 pivotally join rear booms 26*c*, 26*d* to longitudinal beams 18*a*, 18*b* such that rear booms 26*c*, 26*d* pivot about pivot point 30 relative to longitudinal beams 18*a*, 18*b*. In one preferred embodiment, pivot point 30 is several inches. above centerline 34. Brackets 28 position rear booms 26*c*, 26*d* either between longitudinal beams 18*a*, 18*b* (shown) or astride longitudinal beams 18*a*, 18*b* (not shown) such that in a fully collapsed attitude, rear pivoting booms 26*c*, 26*d* are positioned in a side-by-side orientation with longitudinal beams 18*a*, 18*b*.

One or more cross supports or cross braces 36 provide structural integrity to front pair of pivoting booms 26*a*, 26*b*. Those of skill in the art will recognize that alternative cross support configurations may provide structural integrity to front pair of pivoting booms 26*a*, 26*b*. The cross supports or cross braces 38*a*, 38*b*, 38*c*, 38*d* provide structural integrity to rear pivoting booms 26*c*, 26*d*. The cross braces 38 may be formed in a hull-clearing convex or channel shape. In one preferred embodiment, the cross support 38*a* is a "V"-shaped member extending between rear pivoting booms 26*c*, 26*d* which points generally rearward when watercraft lifting apparatus 10 is in an extended configuration as shown in FIG. 1 and point generally downward when watercraft lifting apparatus 10 is in a collapsed configuration as shown in FIG. 2. The hull-clearing "V" shape of cross support 38*a* provides increased clearance for watercraft having generally "V"-shaped hulls as compared with the lifting apparatus of the prior art. Lower cross support 38*b* is a "V"-shaped member which extends between rear pivoting booms 26*c*, 26*d* adjacent pivot point. In one embodiment, cross supports 38*c*, 38*d* extend between the outer ends of intermediate cross support 38*a* and the approximate center of lower cross support 38*b*. Those of skill in the art will recognize that other configurations of cross supports may be employed, for example, intermediate and lower cross supports 38*a*, 38*b* may be formed as a straight beam or in a "U" shape or a "C" shape, and the cross supports 38*c*, 38*d* extending between cross supports 38*a*, 38*b* may be positioned parallel with the rear booms 26*c*, 26*d* or at any other suitable orientation whereby the cross supports 38*a*, 38*b* provide a shape suitable for clearing the bottoms of boats having shaped hulls.

Two mounting arms 40*a*, 40*b* are pivotally mounted adjacent the upper ends of pivoting booms 26 to rotate about pivot points 42*a*, 42*b* and swing with pivoting booms 26 as a mock parallelogram. The invention provides an essentially parallel relationship between mounting arms 40 and longitudinal beams] 8 when lifting apparatus 10 is in a fully extended or upright orientation. The essentially parallel relationships between mounting arms 40*a*, 40*b* and longitudinal beams] 8*a*, ] 8*b*, respectively, are provided by varying the lengths of front pair of pivoting booms 26*a*, 26*b* relative to the lengths of rear pair of pivoting booms 26*c*, 26*d*. When front pivoting booms 26*a*, 26*b* are adapted to pivot about a pivot axis passing through centerlines 34 of both longitudinal beams 18*a*, 18*b*, the lengths "A" of front pivoting booms 26*a*, 26*b* are essentially equal to the lengths "B" of rear pivoting booms 26*c*, 26*d* plus dimension "C" defined as an off-set distance 32 between rear boom pivot point 30 and centerline 34 of longitudinal beams 18*a*, 18*b*. Thus, the relationship between the lengths of front pivoting booms 26*a*, 26*b* and rear pivoting booms 26*c*, 26*d* is given by:

$$A=B+C \qquad \text{(Eq. 1)}$$

where:

A=lengths of rear pivoting booms 26*a*, 26*b* defined as the distance between pivot point 42*a* and a pivot axis passing through centerlines 34 of both longitudinal beams 18*a*, 18*b*, B=lengths of rear pivoting booms 26*c*, 26*d* defined as the distance between pivot point 42*b* and pivot point 30, and C=off-set distance 32 as defined by the vertical distance between rear pivot point 30 and centerline 34.

When lifting apparatus 10 is retracted to a collapsed orientation as shown in FIG. 2, mounting arms 40*a*, 40*b* are oriented at an angle relative to longitudinal beams 18*a*, 18*b*. Mounting arms 40*a*, 40*b* angle downward toward the rear portion of lifting apparatus 10 to provide a self-guiding aspect whereby the bow of a boat is guided into the center of lift apparatus 10 midway between mounting arms 40 by the rising angle of mounting arms 40 leading toward FRONT of lifting apparatus 10. The downward and backward sloping angle of mounting arms 40 is provided in part by the position of pivot point 30 relative to the pivot points of front booms 26*a*, 26*b* about an axis passing through centerline 34 and in part by the shorter lengths of rear pivoting booms 26*c*, 26*d* relative to the lengths of front pivoting booms 26*a*, 26*b*. In one preferred embodiment, watercraft supports (not shown) attached to mounting arms 40 brace the watercraft during lifting.

In one embodiment of the present invention, a suitable actuator, for example a double-acting hydraulic cylinder 44, extends diagonally across the mock parallelogram. Double-acting hydraulic cylinder 44 comprises a piston rod 46 extending from and retracting into a piston jacket 48. In a preferred embodiment, upper end 50 of piston rod 46 is connected to cross rod 52 and cross rod 52 is rotatably fitted in flanges 54 which are attached to front pivoting booms 26*a*, 26*b* adjacent the upper ends of booms 26*a*, 26*b*. Alternatively, upper end 50 of piston rod 46 is connected to a collar (not shown) rotatable on cross rod 52 as disclosed in prior U.S. Pat. No. 5,184,914. Lowering and raising of mounting arms 40 and watercraft supports (not shown) is achieved by extension and retraction of piston rod 46 of double-acting hydraulic cylinder 44. Those of skill in the art will recognize that the present invention may be practiced using alternative raising and lowering means or actuator, for example, pneumatic cylinders, opposing single-acting hydraulic cylinders, electrically driven push/pull rods, or other suitable actuator including chain, cable, or rope pulley drives.

Figure 3:
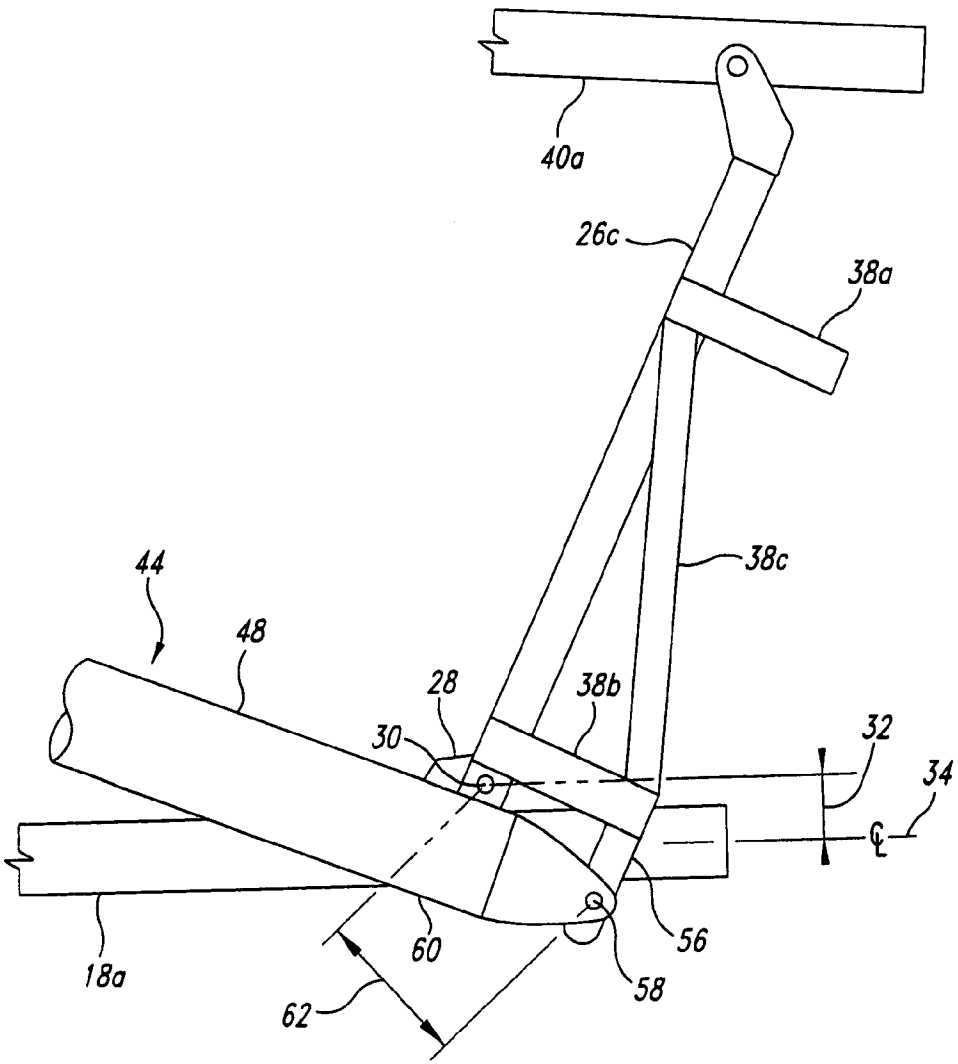
FIG. 3 is a detail view of the double-acting hydraulic cylinder pivotal connection to the rear pivoting booms of the embodiment shown in FIG. 1.

FIG. 3 shows a detail view of the pivotal connection between double-acting hydraulic cylinder 44 and rear pivoting booms 26*c*, 26*d* according to one embodiment of the present invention. A boom extension 56 projects from rear pivoting booms 26*c*, 26*d* opposite pivot point 30 whereby a lever is formed. The lever includes a first lever arm defined by rear pivoting booms 26*c*, 26*d*; a second lever arm defined by boom extension 56; and a fulcrum defined by pivot point 30 positioned between the first and second lever arms. In one preferred embodiment, boom extension 56 projects downward from the approximate center of lower cross support 38*b* and provides a pivot point 58. The lower end 60 of hydraulic cylinder piston jacket 48 is adapted to pivotally connect to boom extension 56 at pivot point 58. According to one preferred embodiment, pivot point 58 is located at a distance 62 from rear boom pivot point 30. Distance 62 provides the lever arm over which the force exerted by hydraulic cylinder 44 acts to rotate rear pair of pivoting booms 26*c*, 26*d* about pivot point 30. In one preferred embodiment of the present invention, pivot point 58 is located at a distance 62 from rear boom pivot point 30 selected to provide an adequate force movement.

Figure 4:
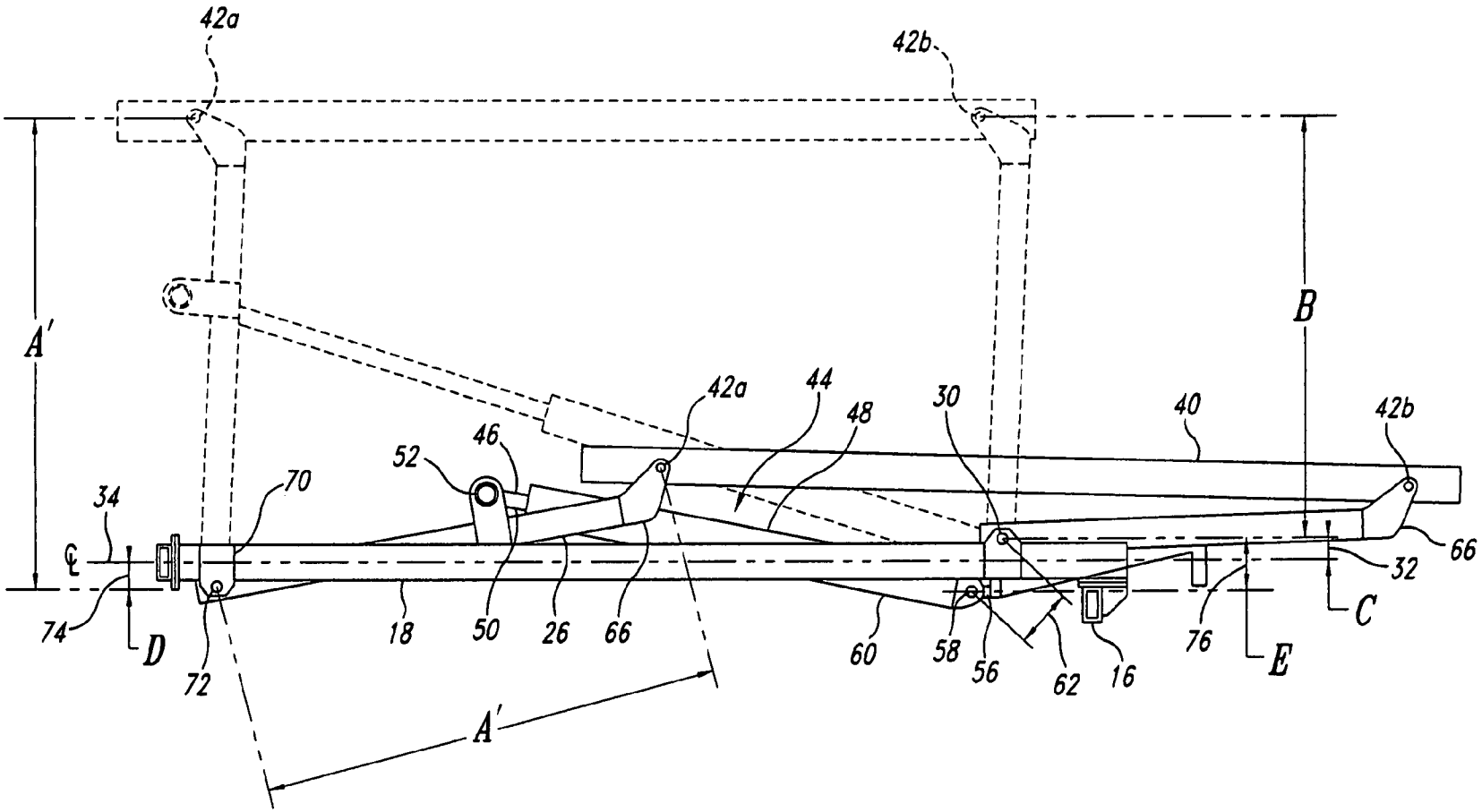
FIG. 4 is an operational side elevation view of the watercraft apparatus of FIG. 1.

FIG. 4 shows an operational side elevation view of the watercraft apparatus according to one embodiment of the present invention. To lift a watercraft from the water, watercraft lifting apparatus 10 is positioned in a first retracted or collapsed configuration (shown in solid) with the craft to be lifted (not shown) floating above mounting arms 40 and watercraft supports, if so equipped. Piston rod 46 of double-acting hydraulic cylinder 44 is extended by introduction of water under pressure into the lower end 60 of piston jacket 48 as disclosed in prior U.S. Pat. No. 5,184,914. A piston (not shown) inside piston jacket 48 extends piston rod 46, forcing cross rod 52 and hence front pivoting booms 26*a*, 26*b* to swing upwardly and forwardly from their collapsed configurations to their raised configuration (shown in phantom). Simultaneously, lower end 60 of piston jacket 48 exerts an equal and opposite force on pivot point 58 of boom extension 56 acting over lever arm distance 62 forcing cross supports 38 and hence rear pivoting booms 26*c*, 26*d* to swing upwardly and forwardly about pivot point 30 from their collapsed configuration to their raised configuration above the water surface (shown in phantom). Pivotally attached mounting arms 40 follow as the mock parallelogram is deployed. Thus, a craft is lifted out of the water on mounting arms 40 or watercraft supports, if so equipped. In a preferred embodiment of the present invention, full extension of watercraft lifting apparatus 10 is achieved when the piston (not shown) inside piston jacket 48 extends piston rod 46 to its fully extended configuration.

Prior U.S. Pat. No. 5,184,914 discloses various alternative means of defining full extension of watercraft lifting apparatus 10 which are fully applicable to the present invention. For example, each longitudinal beam 18*a*, 18*b* may be equipped with boom stops (not shown) located adjacent rear transverse beam 16 and/or adjacent front transverse beam 14 engaging sides of pivoting booms 26 adjacent their lower pivoting ends to brace pivoting booms 26 and mounting arms 40 in their fully extended configuration. Alternatively, full extension of hydraulic cylinder 44 may swing booms 26 from a collapsed or retracted attitude through a vertical attitude into an over-center position. When the hydraulic cylinder reaches its full extension, it prevents further travel of the booms and holds the watercraft lifting apparatus 10 in a fully extended configuration. Another alternative combines both boom stops and an over-center locking position.

According to one embodiment, the present invention provides an over-center locking position including booms stops. The present invention provides brackets 66 connected between the ends of each pivoting boom 26 and the ends of each mounting arm 40. Each bracket 66 provides pivot point 42 such that one mounting arm 40*a* is oriented in a plane defined by front pivoting boom 26*a* and rear pivoting boom 26*c* and the other mounting arm 40*b* is oriented in a plane defined by front pivoting boom 26*b* and rear pivoting boom 26*d*. Brackets 66 are configured to position pivot points 42 such that a portion of mounting arm 40 contacts the end of each pivoting boom 26 when lifting apparatus 10 is in a fully extended upright and over-center configuration. Brackets 66 are further configured such that, when lifting apparatus 10 is oriented in any configuration other than a fully extended upright and over-center configuration, clearance is provided between the ends of each pivoting boom 26 and each mounting arm 40.

Retraction of watercraft lifting apparatus 10 is accomplished by positive retractive energization of double-acting hydraulic cylinder 44 which retracts piston rod 46 into piston jacket 48. Retraction of piston rod 46 causes upper piston rod end 50 to pull front pivoting booms 26*a*, 26*b* from their raised configuration back over-center if an over-center lock is used. Simultaneously, the force exerted by retraction of piston rod 46 acts over lever arm 62 causes lower piston jacket end 60 to pull boom extension 56 upwardly which rotates pivoting booms 26*c*, 26*d* about pivot points 30 from their raised configuration back over-center. After booms 26 pass through their vertical over-center configuration, the weight of booms 26, mounting arms 40 and the supported craft lower watercraft lifting apparatus 10 into its collapsed or retracted configuration.

According to one embodiment of the present invention, longitudinal beams 18*a*, 18*b* are fitted with brackets 70 which include a pivot point 72 extended a distance "0" defined as off-set distance 74 below centerline 34 of longitudinal beams 18*a*, 18*b*. Brackets 70 pivotally join front booms 26*a*, 26*b* to longitudinal beams 18*a*, 18*b* such that front booms 26*a*, 26*b* pivot relative to longitudinal beams 18*a*, 18*b* at pivot point 72. Brackets 70 position front booms 26*a*, 26*b* either between longitudinal beams 18*a*, 18*b*

(shown) or astride longitudinal beams 18*a*, 18*b* (not shown) such that in a fully collapsed configuration, front pivoting booms 26*a*, 26*b* are positioned in a side-by-side orientation with longitudinal beams 18*a*, 18*b*. Positioning of pivot points 72 at offset distance 74 below centerline 34 of longitudinal beams 18*a*, 18*b* accentuates the self-guiding watercraft entry configuration of the invention by accentuating the downwardly and rearwardly sloping angle of mounting arms 40 when lifting apparatus 10 is collapsed. Thus, front boom pivot points 72 are off-set a total vertical off-set distance "E" defined as vertical off-set distance 76 from rear boom pivot points 30 which accentuates the downwardly and rearwardly sloping angle of mounting arms 40 when lifting apparatus 10 is in a collapsed configuration. Off-set distances 32, 74 in combination with the differing lengths of front pivoting booms 26*a*, 26*b* relative to the lengths of rear pivoting booms 26*c*, 26*d* reduces the downwardly sloping angle of mounting arms 40 when booms 26 are fully extended such that mounting arms 40*a*, 40*b* are essentially parallel with longitudinal beams 18*a*, 18*b* when lifting apparatus 10 is in an upright or extended configuration.

According to this embodiment, the essentially parallel relationship between mounting arms 40*a*, 40*b* and longitudinal beams 18*a*, 18*b* when lifting apparatus 10 is in an upright or extended configuration is provided by varying the lengths "A" of front pair of pivoting booms 26*a*, 26*b* relative to the lengths "B" of rear pair of pivoting booms 26*c*, 26*d*. The lengths "A" of front pivoting booms 26*a*, 26*b* minus off-set distance 74 are essentially equal to the lengths "B" of rear pivoting booms 26*c*, 26*d* plus off-set distance 32. Thus, the relationship between the lengths of front pivoting booms 26*a*, 26*b* and rear pivoting booms 26*c*, 26*d* is given by:

$$A'-D \approx B+C \qquad \text{(Eq.2)}$$

where:

A'=lengths of rear pivoting booms 26*a*, 26*b* defined as the distance between pivot point 42*a* and pivot point 72, B=lengths of rear pivoting booms 26*c*, 26*d* defined as the distance between pivot point 42*b* and pivot point 30, C=off-set distance 32 as defined by the distance between pivot point 30 and centerline 34, and D=off-set distance 74 as defined by the distance between centerline 34 and pivot point 72.

In one preferred embodiment, pivot point 72 is several inches below centerline 34.

Stated differently, the lengths "B" of rear pivoting booms 26*c*, 26*d* plus vertical off-set distance 76 between rear boom pivot points 30 and front boom pivot points 72 are essentially equal to the lengths "A" of front pivoting booms 26*a*, 26*b*. Thus, the relationship between the lengths of front pivoting booms 26*a*, 26*b* and rear pivoting booms 26*c*, 26*d* is alternatively given by:

$$A' \approx B+E \qquad \text{(Eq.3)}$$

where:

A'=lengths of rear pivoting booms 26*a*, 26*b* defined as the distance between pivot point 42*a* and pivot point 72, B=lengths of rear pivoting booms 26*c*, 26*d* defined as the distance between pivot point 42*b* and pivot point 30, and E=off-set distance 76 as defined by the vertical distance between rear pivot point 30 and front pivot point 72.

Figure 5:
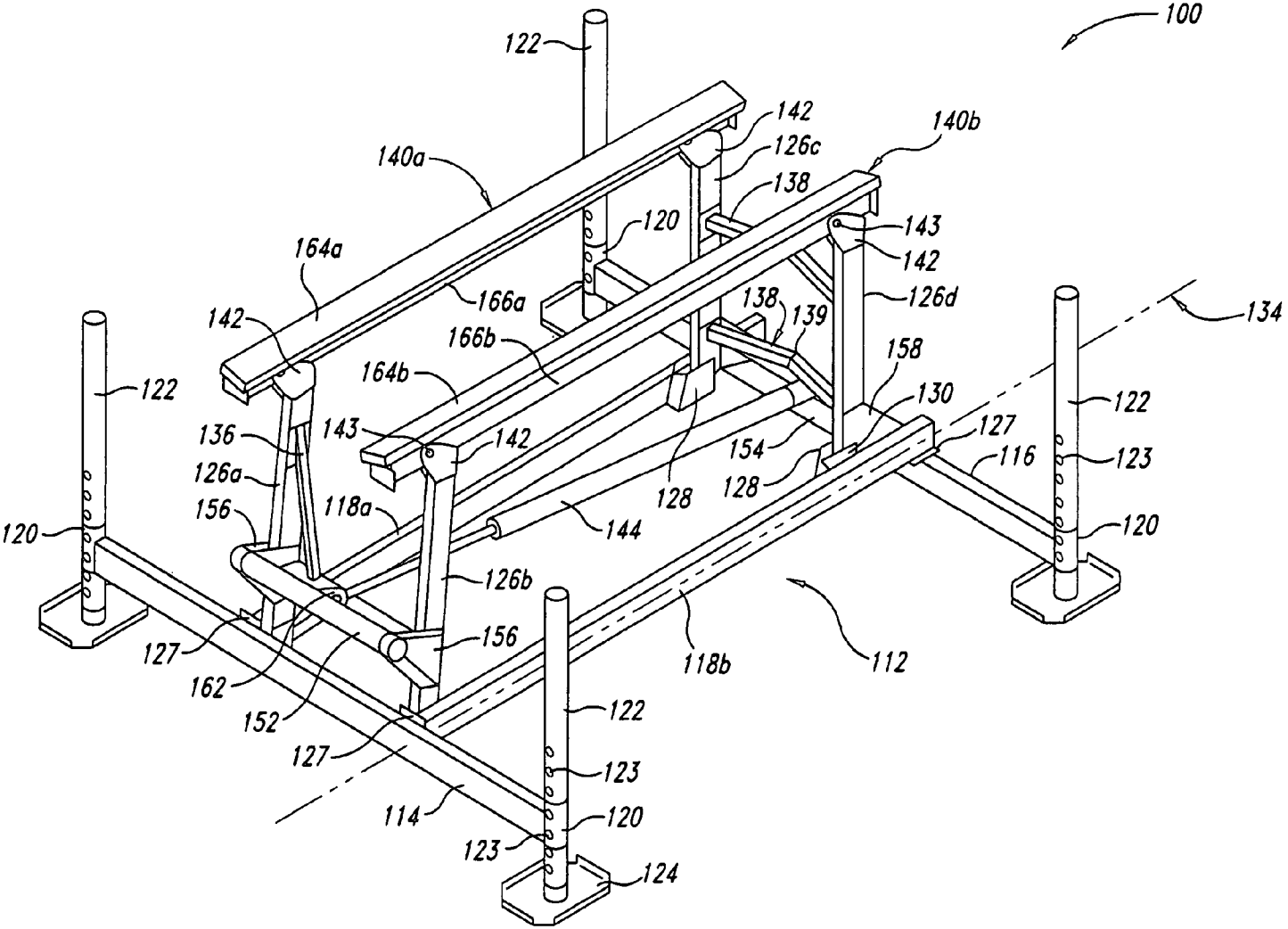
FIG. 5 is an isometric projection of another embodiment of a low profile lift for watercraft in accordance with the invention.
Figure 6:
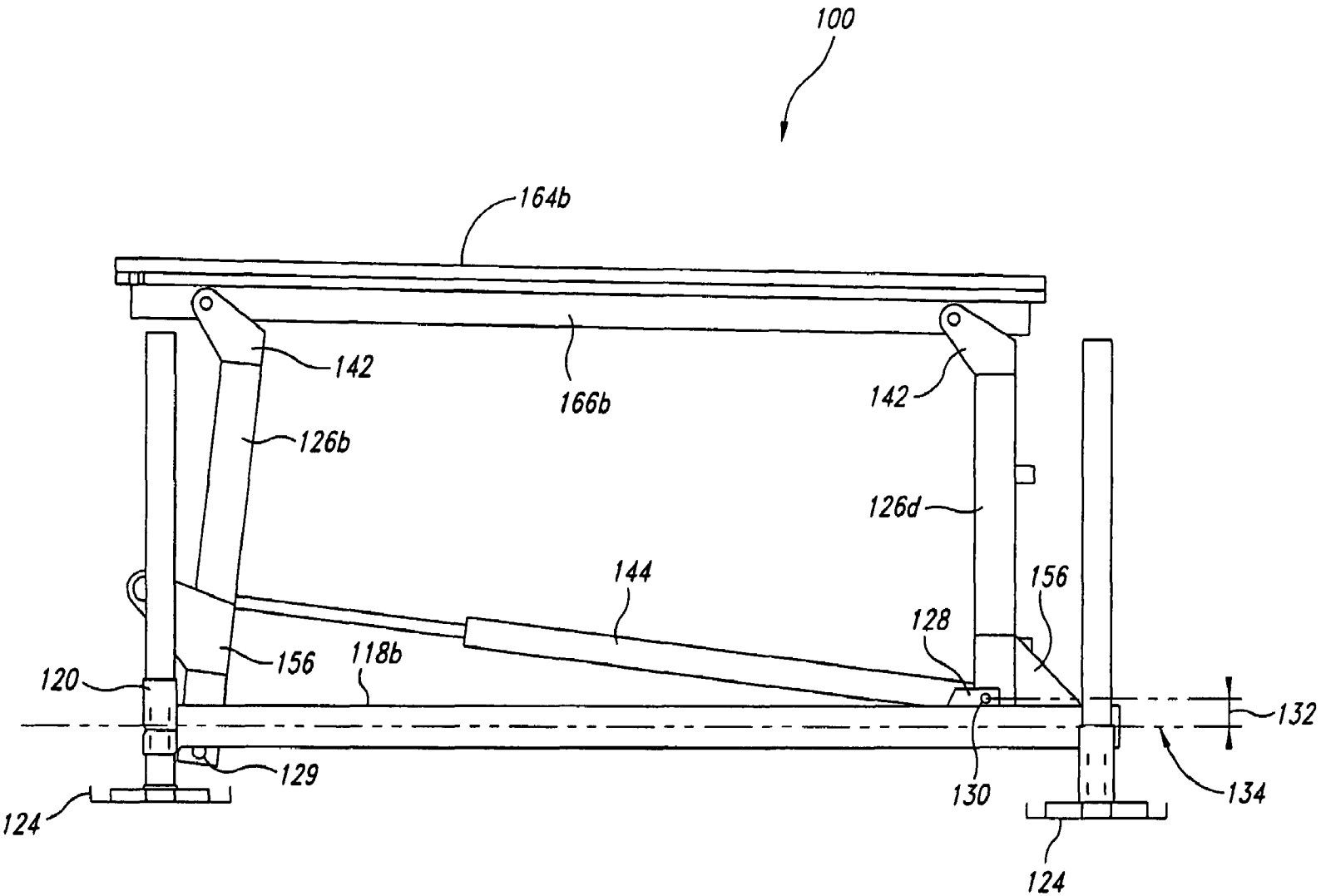
FIG. 6 is a side plan view of the lift of FIG. 5 in an extended configuration.
Figure 7:
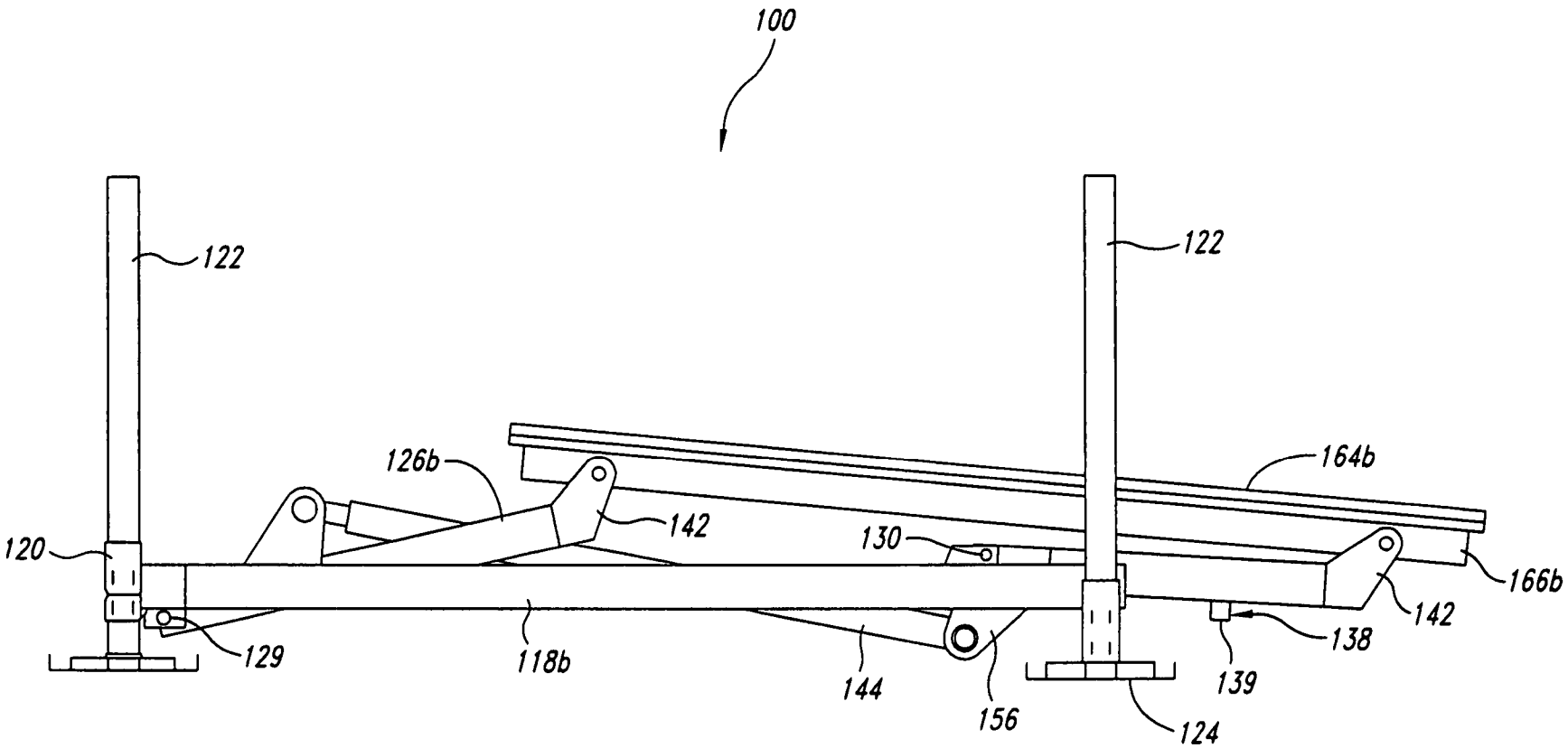
FIG. 7 is a side plan view of the lift of FIG. 5 in a retracted configuration.
Figure 8:
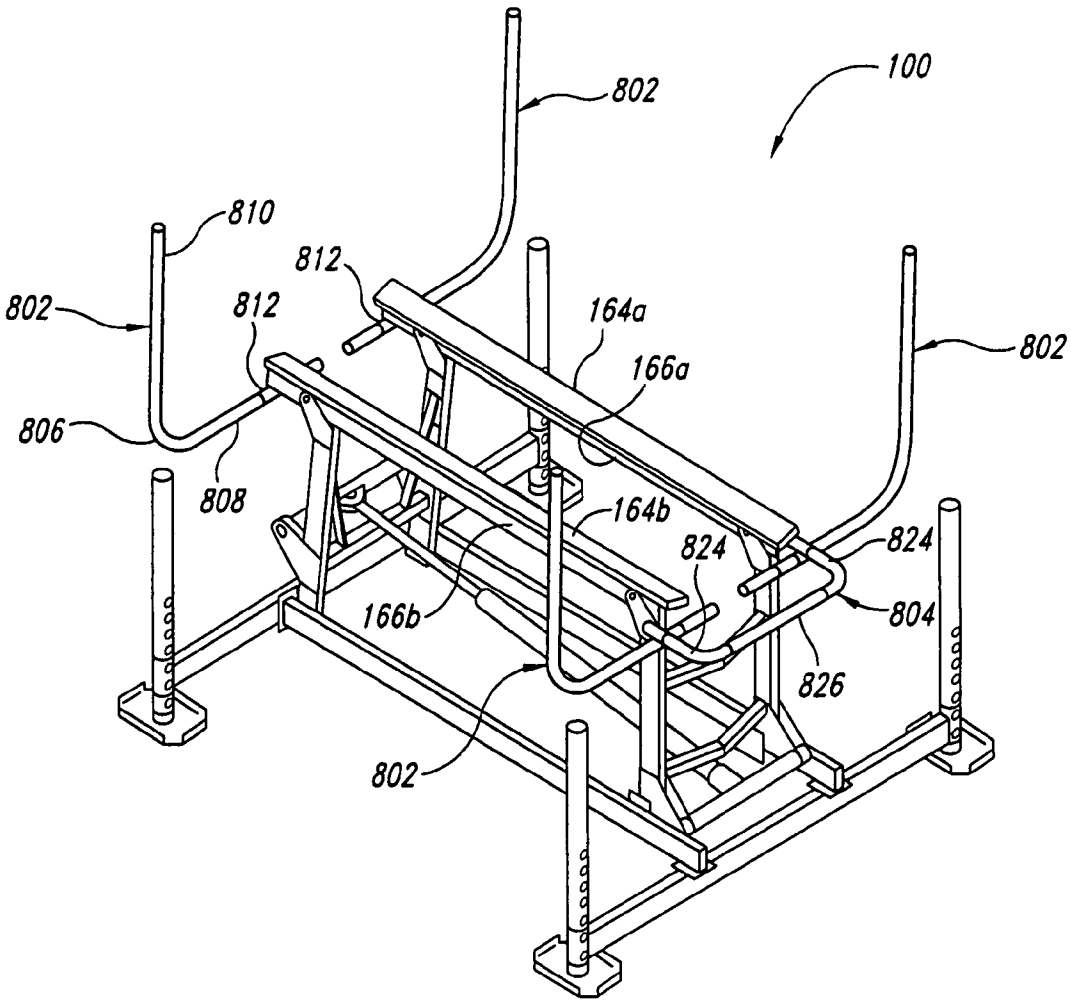
FIG. 8 is an isometric projection of the lift of FIG. 5 showing optional attachments.
Figure 9:
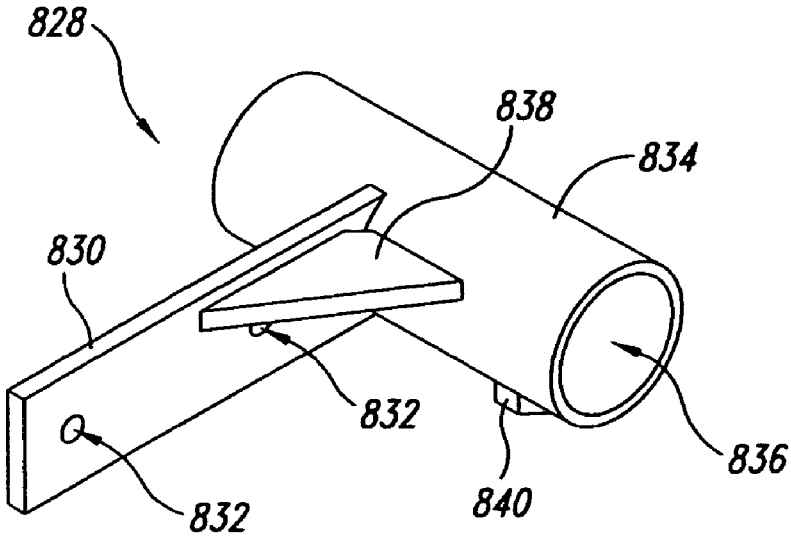
FIG. 9 is an isometric projection of a first attachment bracket in accordance with the invention.

Referring next to FIGS. 5–7, another embodiment of a lift 100 formed in accordance with the invention is shown. The lift 100 includes a rectangular base 112 formed from front and rear transverse beams 114, 116, respectively, that are each connected to parallel longitudinal beams 118*a*, 118*b*. A sleeve 120 is connected to each of the transverse beams 114, 116. Each sleeve 120 is sized and shaped to receive a support post 122. A plurality of openings 123 in each sleeve 120 and each support post 122 enables independent adjustment of the base 12 relative to support shoes 124, which can rest on a river bed or lake bed.

Four pivoting booms 126*a*, 126*b*, 126*c*, 126*d*, are pivotally attached to the rectangular base 112 at each of the four corners 127. Ideally, brackets 128 are connected to the rear booms 126*c*, 126*d* and the longitudinal beams 118*a*–*b* such that the rear booms 126*c*, 126*d* pivot about a pivot point 130. The pivot point 130 is a distance 132 that is several inches above a longitudinal axis 134 of the longitudinal beams 118*a*, 118*b*. In one embodiment the pivot point is in the range of five (5) to twelve (12) inches above the axis 134. In the embodiment shown, the brackets 128 position the rear booms 126*c*, 126*d* inside the longitudinal beams 118*a*–*b*, although the brackets 128 can be mounted astride the longitudinal beams 118*a*–*b* such that when in a fully collapsed configuration, the rear pivoting booms 126*c*, 126*d* are positioned in a side-by-side orientation with the longitudinal beams 118*a*–*b*. A first pair of cross braces 136 provides structural integrity to the front pair of pivoting booms 126*a*, 126*b*. A second pair of cross braces 138 provides structural integrity to the rear pivoting booms 126*c*, 126*d*. In the depicted embodiment, the cross braces 138 are formed to have a v-shape, with the vertex 139 pointing downward when the lift 100 is in a collapsed configuration, as shown in FIG. 7. This v-shape of the cross support 138 provides increased clearance for a watercraft having generally v-shaped hulls. Other configurations of the cross brace 138 may also be used as desired.

Mounted to the top of pivoting booms 126*a* and 126*c* is a support rail 140*a*; and similarly mounted to pivoting booms 126*b*, 126*d* is a support rail. Mounting brackets 142 are fixedly attached to pivoting booms 126*a*–*d* and provide a pivot attachment point 143 for attachment of the support rails 140*a*–*b*.

The length and function of the pivoting booms 126*a*–*d* is the same as described above with respect to the pivoting booms 26*a*–*d* in FIG. 1, and will not be described in detail herein. As shown in FIG. 6, the support rails 140*a*–*b* are essentially parallel to the longitudinal beams 118*a*–*b* when the lift 100 is in the extended configuration.

An actuator 144, similar to the double-acting hydraulic cylinder 44 described above with respect to FIG. 1, is connected to the pivoting booms 126*a*–*d* by means of a front T-bar 152 connected to forward pivoting booms 126*a*, 126*b* and a rear T-bar 154 connected to rear pivoting booms 126*c*, 126*d*. The front T-bar 152 is rotatably mounted to support brackets 156, each attached to a respective pivoting boom 126*a*, 126*b*. The rear T-bar 154 is similarly pivotally attached to support brackets 158 that are each attached to pivoting booms 126, 126*d*. The actuator 144 is attached to the rear T-bar 154 with a sleeve 160 and to the front T-bar 152 by a yolk 162. Ideally, the T-bars 152, 154 can be easily replaced to facilitate interchangeability of high-pressure and low-pressure activators.

In a preferred embodiment, a bunk 164*a,b* is pivotally mounted to each support rail 166*a,b*. The bunks 164*a,b* can pivot about a longitudinal axis that is parallel to the axis 134 of the longitudinal beams 118*a*–*b*. The bunks I 64*a,b* can either freely pivot or be attached to a fixed orientation, thus accommodating hulls of a particular configuration.

Referring again to FIGS. 6 and 7, the relationship between the actuator 144 and the pivoting booms 126*a–d* is illustrated. In FIG. 6, the lift 100, working in a cantelever arm arrangement, is in an extended configuration wherein the actuator 144 is fully extended. In FIG. 7, the lift 100 is in a collapsed configuration wherein the actuator 144 is retracted.

In a preferred embodiment, the front pivoting booms 126*a,b* have a pivot point 129 that is lower than the pivot point 130 of the rear pivoting booms 126*c,d*. The relative distance between the pivot points 129, 130 ranges from four inches to ten inches, and in the configuration shown in FIG. 6, is eight inches. In other words, the rear pivot point 130 is approximately 8 inches higher than the front pivot point 129. It is to be understood that these distances can vary according to the size of the lift 100.

The actuator 144 provides a linkage through the front and rear T-bars 152, 154 with the pivoting booms 126*a–d*. When mounted as shown, the actuator 144 provides a pushing force on the forward and rear booms 126*a–d*. The pushing action of the actuator 144, in combination with the moving mounting points of the actuator 144 on the pivoting booms 126*a–d*, enables lifting of loads with nearly uniform force throughout the travel of the pivoting booms 126*a–d*.

In addition, as shown in FIG. 7, when the lift 100 is in a retracted or collapsed configuration, the bunks 164*a,b* are angled downward towards the rear of the lift 100. This facilitates in loading of watercraft, especially in very shallow water.

Referring next to FIGS. 8–12, shown therein is the lift 100 of FIG. 5 having optional accessories attached thereto. More particularly, four guide-ons 802 are attached near the free ends of the pivoting booms 126*a–d*. In addition, a stern stop 804 is connected to the upper ends of the pivoting booms 126*c,d*.

Each of the guide-ons 802 are formed from tubular members 806 having a 90° bend to create first and second legs 808, 810, respectively. The first leg 808 is attached to the lift 100 by an attachment bracket 812, which is shown more clearly in FIG. 10.

Figure 10:
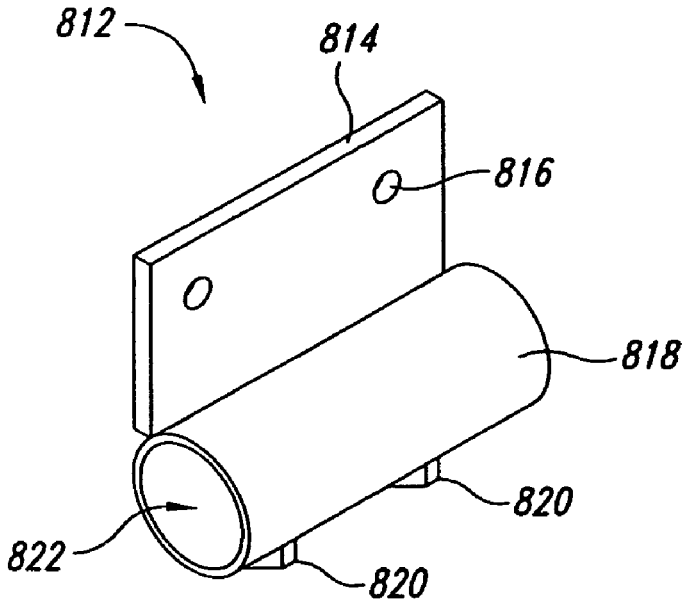
FIG. 10 is an isometric projection of a second attachment bracket in accordance with the invention.

Referring to FIG. 10, the attachment bracket 812 comprises a mounting plate 814 having a pair of mounting holes 816 formed therein. Attached to the plate 814 adjacent the holes 816 is a sleeve 818 sized and shaped to slidably receive the first leg 808 of the guide-on 802. A pair of set screws 820 are threadably engaged with the sleeve 818 such that as the screws 820 are threaded into the sleeve 818, they project into the internal bore 822 of the sleeve 818 and will bear against the guide-on 802. Alternatively, holes may be formed in the guide-on 802 to accept the screws 820.

The stem stop 804 is of tubular construction having aU-shaped configuration with two legs 824 joined at a 90° bend by a cross member 826. The stern stop 804 is attached to the bunk support rails 166*a,b* with attachment brackets 828, shown in greater detail in FIG. 9. As shown therein, each attachment bracket 828 includes a mounting plate 830 with openings 832 formed therein, that is attached to or integrally formed with a sleeve 834. The sleeve 834 has a longitudinal axial bore 836 with a circular cross-sectional configuration. The mounting plate 830 is attached at a right angle to the sleeve 834 and reinforced with a gusset 838. A pair of set screws 840 (only one shown in 5 FIG. 9) are threadably received in the sleeve 834 such that when tightened, they project into the axial bore 836 and will bear against the stem stop 804 or be received in preformed holes in the stem stop 804, as shown in FIG. 11.

Figure 11:
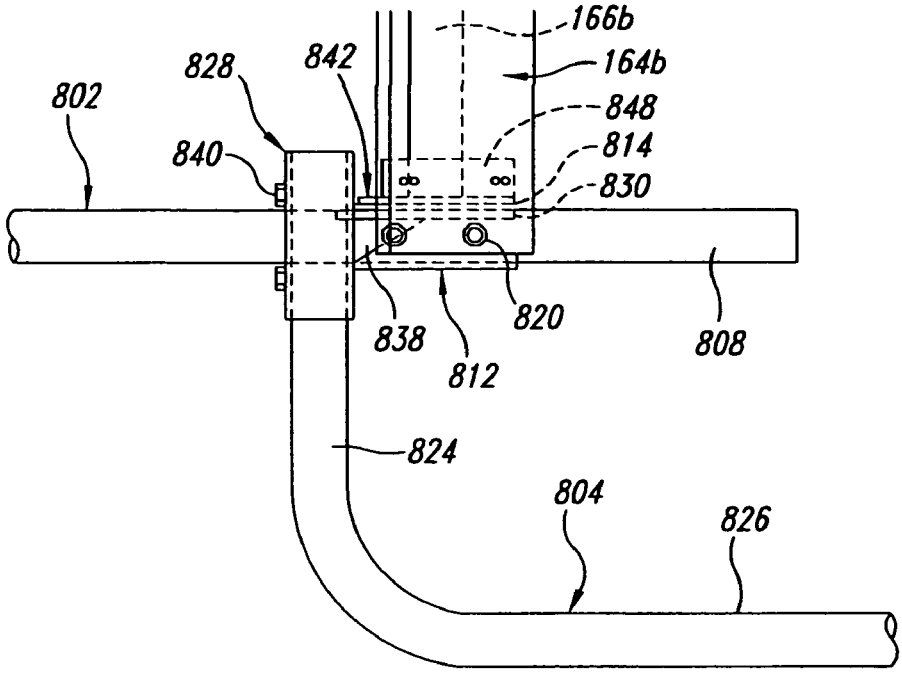
FIG. 11 is a partial top plan view of the accessories of FIG. 8 mounted on the lift with the brackets of FIGS. 9 and 10.
Figure 12:
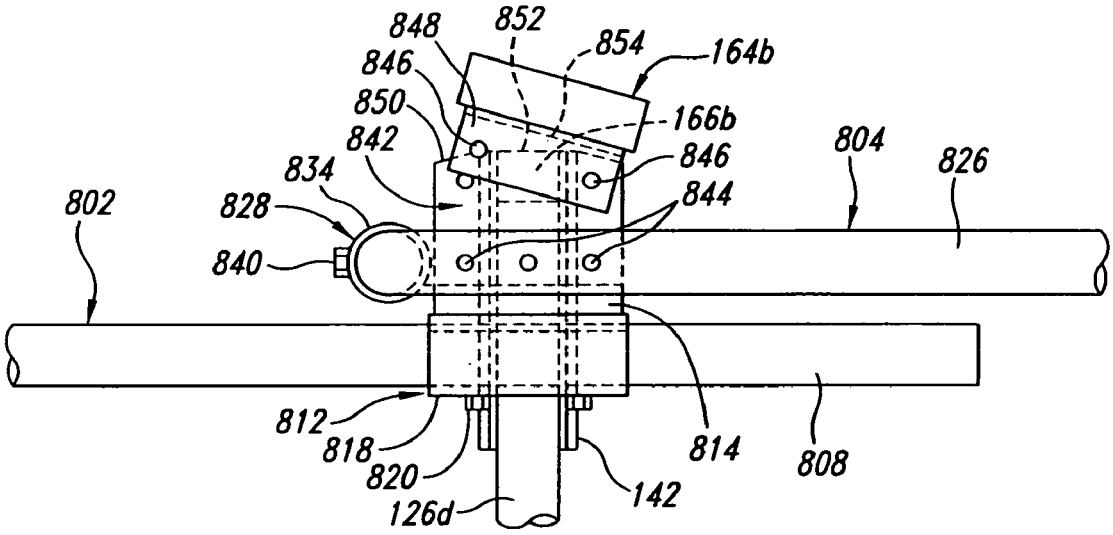
FIG. 12 is a partial front plan view of the accessory mounting of FIG. 11.

FIGS. 11 and 12 show the attachment of the guide-on 802 and stem stop 804 to the bunk support rail 166*b* on the pivoting boom 126*d*. To facilitate mounting of the brackets 812, 828 and the bunk 166*b* to the support rail 164*b*, a universal plate 842 is provided. As shown more clearly in FIG. 12, the universal plate 842 has a substantially rectangular configuration with one of its planar sides attached to the support rail 166*b*~preferably by welding, although other attachment means known in the art may be used. Mounting holes 844 centrally located on the universal plate 842 are used for attachment of the brackets 812, 828. Additional holes 846 are provided near the top of the universal plate 842 for attachment of the bunk 164*b*. As shown here, a bunk attachment plate 848 connects the bunk 164*b* to the universal plate 842.

As shown in FIG. 12, the bunk attachment plate 848 is connected to the universal plate 842 through one opening 846 (on the right side) to permit rotation of the bunk 164*b* about an axis that is parallel with the axis 134 of the longitudinal beam 118*b*. This permits orienting the bunk 164*b* to accommodate different hull shapes. The bunk 164*b* can be attached to the bunk support rail 166*b* in a fixed orientation, or it can be freely rotatable, as desired.

To enable the bunk 164*b* to rotate without interference from the universal plate 842, the top corners 850 of the plate 842 are angled downward as shown. However, the top edge 852 between the corners 850 remains straight to provide a bearing surface for the bottom surface 854 of the bunk bracket 848. This prevents the bunk 164*b* from inadvertently rotating counterclockwise (from the orientation shown in FIG. 12) and causing damage to a boat hull.

As shown more clearly in FIG. 11, the guide-on 802 mounting bracket 812 is first attached to the universal plate 842 followed by the stem stop bracket 828 through the openings 844 with suitable fasteners (not shown). The guide-ons 802 and stem stop 804 are inserted into their respected sleeves 818, 834 where they are slidably received for adjustable positioning to accommodate the watercraft. The guide-ons 802 aid in centering the watercraft on the lift 100, while the stem stop 804 is contacted by the stem drive or outboard drive to position the boat longitudinally on the lift 100.

Suitable materials for use in a marine environments, as known to those skilled in the art, can be used to construct the components of the lift 100, including the accessories described above, i.e., the guide-ons 802, stem stop 804, and associated brackets 812, 828, and universal plate 842, and fasteners. The guide-ons 802, as well as the stem stop 804, can be formed from sturdy plastic that will help prevent damage to the exterior of the boat hull and the stem drive or outboard drive components.

Another embodiment of the invention is shown in FIGS. 13–16. A floating lift 200 is provided that includes a watercraft lift 202 attached to a support frame 204 having first and second pontoons 206, 208 attached thereto. The lift 202 is adapted from the design of the lift 100 described above. It is to be understood, however, that this embodiment of the invention can be used with other lifts as well as those described herein.

The support frame 204 includes two adjustable transverse beams 210, 212 that are attached to the lift 202 by connectors 214 located on each end 216 of the parallel longitudinal beams 218*a*, 218*b* on the lift 202. Attachment to the connectors 214 may be accomplished by welding, fasteners, or other known methods. The transverse beams 210, 212 is formed of tubular metal having a substantially square cross-sectional shape that defines a hollow longitudinal interior 220 that opens at each end 222. The lift 202 holds the transverse beams 210, 212 in spaced parallel relationship.

The support frame 204 further includes four support stands 224 located at each end 222 of the transverse beams 210, 212. In the illustrated embodiment, each support stand 224 includes a base plate 226 having an upright support member 228 slidably mounted to an attachment post 242 of the base plate 226 attached to a top surface 230 to project at substantially a right angle from the base plate 226. Extending laterally from the upright support member 228 is a lateral beam 232 sized and shaped to be slidably received within the transverse beams 210, 212. Fasteners 234 at each end 216 of the transverse beams 210, 212 secure the lateral beams 232 to the transverse beams 210, 212, and permit telescopic adjustment in the position thereof. The lateral beam 232 is fixedly attached to the upright support 228.

Figure 13:
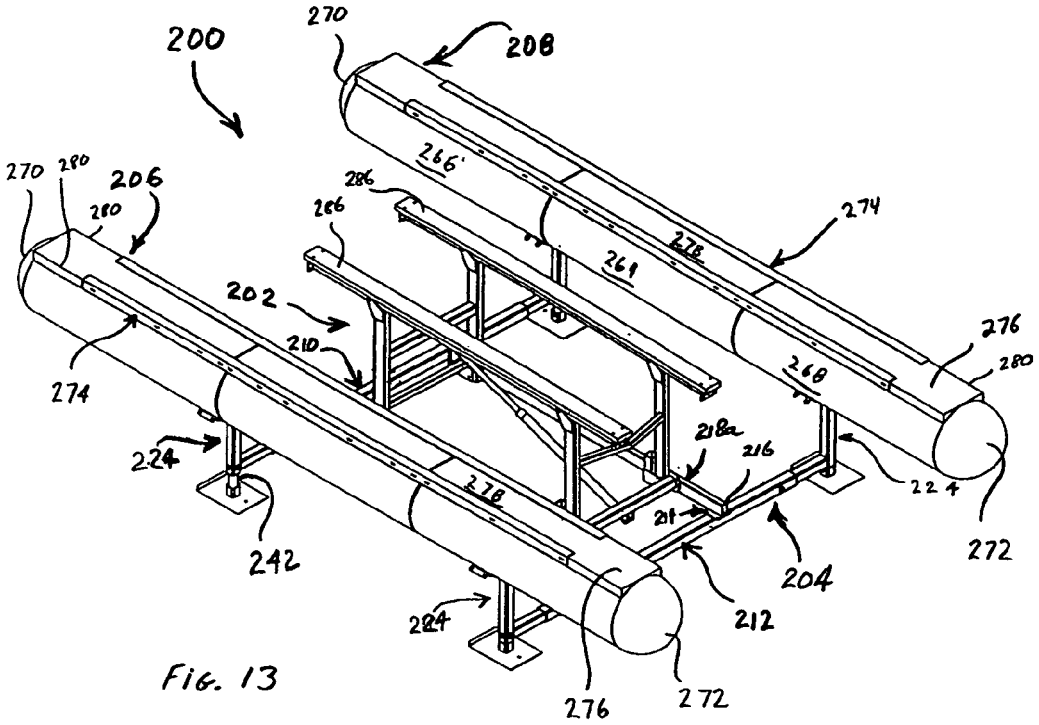
FIG. 13 is an isometric projection of a floating lift formed in accordance with the present invention.
Figure 14:
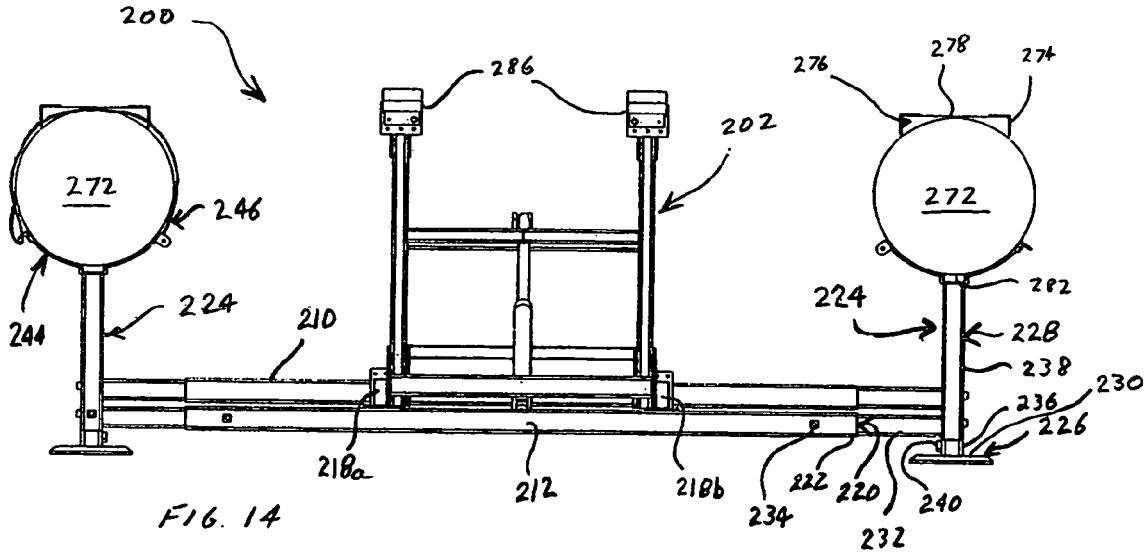
FIG. 14 is a front elevation view of the floating lift of FIG. 13.
Figure 15:
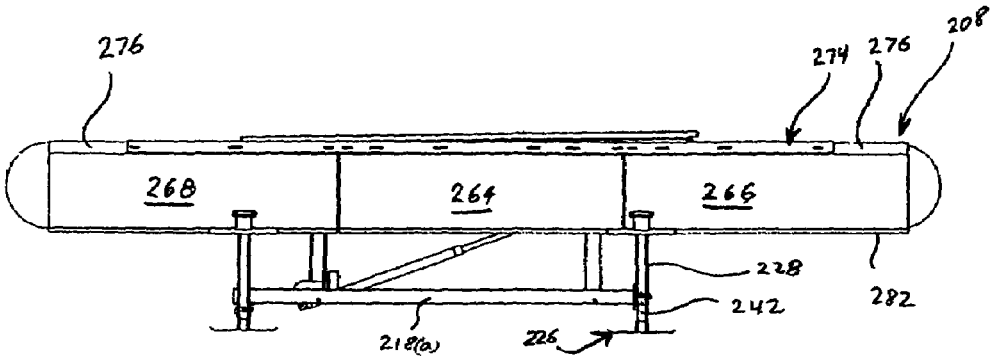
FIG. 15 is a side elevational view of the floating lift of FIG. 13.

A base support 236 is attached to the base plate 226 and the attachment post 242 is sized and shaped to be slidably received within the base support 236 and held in place by a fastener 240. Thus, as shown in FIG. 13, the position of the upright support member 228 can be adjusted by sliding the upright support 238 along the attachment post 242. In the embodiment shown in FIG. 13, the upright support member 228 at the end 216 of the first transverse beam 210 slides upward on the adjustment post projecting from the base support 236 to accommodate the pontoons moving up and down with changing water levels.

Figure 16:
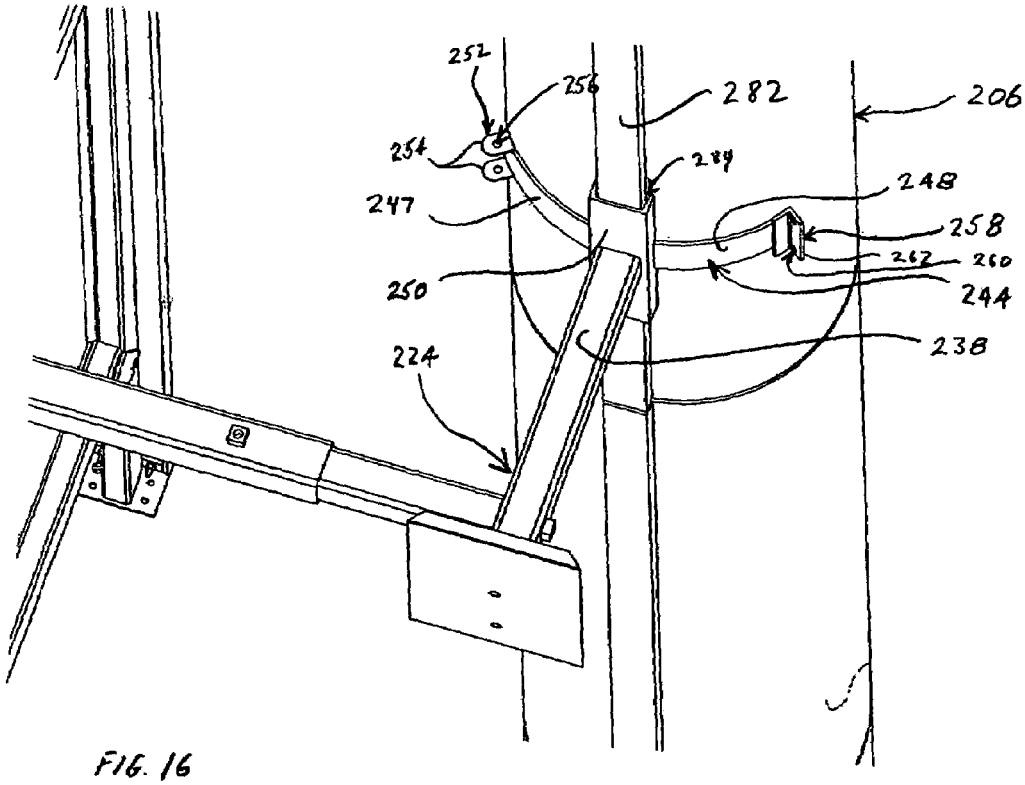
FIG. 16 is an enlarged isometric projection from a bottom view of the pontoon attached to the lift.

Each pontoon 206, 208 is supported on the four support stands 224 by an attachment bracket 244 and adjustment strap 246. The attachment bracket 244, as shown more clearly in FIG. 16, is comprised of a first arcuate bracket member 247 and a second accurate bracket member 248 extending from a channel bracket 250 attached to the upright support 238. At one end of the first bracket member 247 is a yolk 252 comprising a pair of ears 254 projecting in parallel at approximately a 90° angle from the central member 248. Openings 256 in each ear 254 are provided for attaching the adjustment strap 246. An angle bracket 258 is attached to the second bracket member 248 and includes two openings 260 in a leg 262 of the bracket 258 for attachment to another end of the adjustment strap 246. The attachment straps 246 in one embodiment comprise a nylon strap that over the angle iron and the deck piece 276, and has a loop in each end. A bolt passes through the loop in one end to attach to the two ears 254, and a V-bolt is used with the other end to attach to the angle bracket 258 via the openings 260.

Each pontoon 206, 208 is comprised of a center section 264 attached between a first end section 266 and a second end section 268. A first end cap 270 is attached to the exposed end of the first end section 266 and a second end cap 272 is attached to the exposed end of the second end section 268 on each of the pontoons 206, 208. Each of the sections 264, 266, 268 comprises an airtight flotation chamber having a hollow interior formed in a conventional manner known to those skilled in the art and, hence, will not be described in detail herein. Further, each of the sections 264, 266, 268 are slidably attached in a conventional manner that will not be described in detail. Each pontoon 206, 208 is held together by angle irons 274 that extend across the central section 264 and substantially across both the first and second end sections 266, 268. A deck piece 276 is formed on each of the pontoon sections 264, 266, 268 to form a longitudinal deck surface 278 that is substantially flat along the entire length of each pontoon 206, 208 with the exception of the first and second end caps 270, 272. The angle irons 274 are attached along the two exposed corners 280 of the deck pieces 276 with suitable fasteners (not shown). Preferably, the angle irons 274 are bolted to the pontoons 206, 208 with bolts that thread into holes having brass or stainless steel inserts molded into the deck pieces 276.

In one embodiment, the deck pieces 276 are molded, such as roto molding or blow molding, during the formation of the center and end section tanks 264, 266, 268. Each tank has one end that is convex and another end that is concave to facilitate interlocking with other tanks to form the pontoons 206, 208. The end sections 266, 268 were integrally formed therewith.

On an opposing side of each pontoon 206, 208 from the deck piece 276 is formed a raised longitudinal rail 282. In one embodiment, the rail is integrally formed with each of the pontoon sections 264, 266, 268. The channel bracket 250 at the top of each support stand 224 is sized and shaped to receive the rail 282 therein. In other words, the channel bracket 250 has a substantially V-shaped cross-sectional configuration to from a channel 284 that receives the rail 282 having a similar cross-sectional configuration. The attachment bracket 244 is integrally formed with the channel bracket 250 so that the adjustment strap 246 holds the pontoons 206, 208 to the support stand 224.

In use, the floating lift 200 is positioned in a body of water with the support frame 204 attached to the floor of the body of water. Each base plate 226 is suitably secured in a conventional manner that will not be described in detail herein. The support stands 224 are laterally positioned by sliding the lateral beams 232 with respect to the front and rear transverse beams 210, 212 and affixing them with suitable fasteners. Once the support stands 224 are anchored, the pontoons 206, 208 are permitted to move vertically along the adjustment post 242, thus keeping the lift 202 at the right height with respect to the surface of the water. The size and shape of the fenders 206, 208 is such that they will resist pitching under the dock and getting stuck.

Ideally, each pontoon section 264, 266, 268 is constructed of a pliable material, such as rendering material, so that the pontoons 206, 208 act as fenders. As such, they can bump off an adjacent dock, and they provide centering for a boat with respect to the bunks 286 on the lift 202. The deck pieces 276 provide a deck upon which users can walk. The angle brackets 258 also provide attachment points in the openings 260 for cleats and other accessories.

What is claimed is:

1. A watercraft lifting apparatus, comprising:

a buoyant support apparatus having a support frame configured to be anchored with respect to a body of water and a floatable frame slidably mounted on the support frame; and a lift attached to the buoyant support apparatus, the lift comprising:

a base;

a first boom having a first end pivotally joined to said base to rotate about a first axis and a boom extension projecting from said first end thereof;

a second boom having a first end pivotally joined to said base to rotate about a second axis;

water craft supports pivotally connected to said booms; and an actuator pivotally connected to said boom extension to rotate about a third axis that is offset from the first axis and pivotally connected to said second boom between the first end thereof and a distal end.

2. The watercraft lifting apparatus recited in claim 1 wherein the third axis is parallel to and offset away from the first end of the first boom and away from the first axis.

3. The watercraft lifting apparatus recited in claim 1 wherein the first boom is joined to said base at a first pivot point positioned between the first end thereof and a distal end of said boom extension, and said actuator is pivotally connected adjacent said distal end of said boom extension.

4. The watercraft lifting apparatus recited in claim 3 wherein said first boom has a first length and said second boom has a second length different from said first length.

5. The watercraft lifting apparatus recited in claim 4 wherein said second boom is pivotally connected to said base at a second pivot point spaced a vertical distance below said first pivot point.

6. The watercraft lifting apparatus recited in claim 5 wherein said second length is essentially equal to said first length plus said vertical distance.

7. The watercraft lifting apparatus recited in claim 1 wherein said first boom includes laterally opposed structural portions pivotally joined to said base and a hull-clearing channel portion formed therebetween and projecting out of the plane of said laterally opposed structural portions.

8. The watercraft lifting apparatus recited in claim 7 wherein said hull-clearing channel portion is formed in a "V" shape.

9. A watercraft lifting apparatus comprising:

a buoyant support apparatus comprising a buoyant frame slidably mounted to a fixed frame configured to be fixed to the floor of a body of water; and a lift attached to the buoyant frame, the lift comprising:

a generally rectangular base having a longitudinal axis;

first and second pairs of booms, each of said first and second pairs of booms having first ends and second opposite ends, said first ends pivotally connected to said base at opposite ends of said longitudinal axis, said first boom including a boom extension projecting from said boom adjacent said pivotal connection to said base such that said pivotal connection to said base is positioned between said second end of said first pair of booms and a distal end of said boom extension;

watercraft supports pivotally connected to said second ends of said first and second pairs of booms whereby a four-bar linkage is formed; and an actuator pivotally connected between said first and second pairs of booms and operable for rotating said first and second pairs of booms, a first end of said actuator pivotally connected to said first pair of booms adjacent said distal end of said boom extension and a second end of said actuator pivotally connected to said second pair of booms adjacent said second end of said second pair of booms, whereby said watercraft supports are moved from a first position adjacent said base to a second position spaced away from said base.

10. The watercraft lifting apparatus recited in claim 9 wherein said first pair of booms has a first length measured between said pivotal connection to said watercraft supports and said pivotal connection to said base, and said second pair of booms has a second length measured between said pivotal connection to said watercraft supports and said pivotal connection to said base different from said first length.

11. The watercraft lifting apparatus recited in claim 10 wherein said pivotal connection of said first pair of booms to said base defines a first pivot point and, said second pair of booms is pivotally connected to said base at a second pivot point spaced a vertical distance below said first pivot point.

12. The watercraft lifting apparatus recited in claim 11 wherein said second length is essentially equal to said first length plus said vertical distance.

13. The watercraft lifting apparatus recited in claim 9 wherein said first pair of booms further comprises:

laterally opposed structural portions pivotally joined to said base and said watercraft supports; and a shaped hull-clearing portion formed between said structural portions.

14. The watercraft lifting apparatus recited in claim 13 wherein said shaped hull-clearing portion is formed in a "V" shape.

15. A watercraft lifting apparatus comprising:

a buoyant support apparatus; and a lift attached to the buoyant support apparatus, the lift comprising:

a generally rectangular base formed of two longitudinal beams joined at each end by first and second transverse beams;

a first pair of booms comprising first and second booms each having first and second opposite ends, a boom extension projecting from said first ends, and pivots adjacent said first ends for pivotally connecting said first and second booms to a respective one of said longitudinal beams adjacent said first transverse beam;

a second pair of booms having first and second opposite ends, said first ends pivotally connected to a respective one of said longitudinal beams adjacent to said second transverse beam;

a plurality of watercraft supports pivotally connected to said second ends of said first and second pairs of booms; and an actuator having a first end pivotally connected between said second ends of said second pair of booms and said base, and a second end pivotally connected adjacent to a distal end of said boom extension, said actuator operable for rotating said first and second pairs of booms.

16. The watercraft lifting apparatus recited in claim 15 wherein said first pair of booms has a first length measured between said pivotal connection to said watercraft supports and said pivotal connection to said longitudinal beams, and said second pair of booms has a second length measured between said pivotal connection to said watercraft supports and said pivotal connection to said longitudinal beams different from said first length.

17. The watercraft lifting apparatus recited in claim 16 wherein said pivots pivotally connecting said first pair of booms to said longitudinal beams define first pivot points and, said pivotal connection of said second pair of booms to said longitudinal beams define second pivot points spaced a vertical distance below said first pivot points.

18. The watercraft lifting apparatus recited in claim 17 wherein said second length is essentially equal to said first length plus said vertical distance.

19. A watercraft lifting apparatus, comprising:

a pair of floats mounted to a support frame;

a plurality of support stands slidably mounted to the support frame and configured for fixed attachment to the bed of a body of water; and a lift attached to the support frame, the lift comprising:

a base;

a first boom having a first end pivotally joined to the base to rotate about a first axis and a boom extension projecting from the first end thereof;

a second boom having a first end pivotally joined to the base to rotate about a second axis;

watercraft supports pivotally connected to the booms; and an actuator pivotally connected to the boom extension to move the first boom, the second boom, and the water craft supports between a collapsed configuration and an extended configuration that is over center with respect to the collapsed configuration, the actuator configured to stop movement of the first boom, the second boom, and the watercraft supports in the extended configuration when the actuator reaches a maximum point of travel.

20. The watercraft lifting apparatus of claim 19, wherein the actuator is configured to rotate about a third axis that is offset form the first axis and pivotally connected to the second boom between the first end thereof and a distal end.

21. A watercraft lifting apparatus, comprising:

a buoyant support apparatus; and a lift attached to the buoyant support apparatus, the lift comprising:

a base a first boom having a first end pivotally joined to the base to rotate about a first axis;

a second boom having a first end pivotally joined to the base to rotate about a second axis;

a watercraft support apparatus pivotally connected to a second end of the first boom and a second end of the second boom; and an actuator pivotally connected to the first and second booms to rotate about a third axis to move the first and second booms and the watercraft support apparatus between a collapsed configuration and an extended configuration that is over center with respect to the collapsed configuration, the actuator configured to fully extend and hold the first and second booms and the watercraft support apparatus in the extended configuration, wherein the third axis is offset from the first axis and is parallel and offset away from the first end of the first boom and away from the first axis, and wherein the first boom is joined to the base at a first pivot point positioned between the first end thereof and a distal end of a boom extension formed on the first boom to which the actuator is attached, the actuator pivotally connected adjacent a distal end of the boom extension.

* * * * *